US006344165B1

(12) United States Patent
Coleman

(10) Patent No.: US 6,344,165 B1
(45) Date of Patent: Feb. 5, 2002

(54) MANUFACTURE OF RECONSTITUTED WOOD PRODUCTS

(75) Inventor: John D. Coleman, Surrery Hills (AU)

(73) Assignee: Commonwealth Scientific and Industrial Research Organisation, Campbell (AU)

( * ) Notice: Subject to any disclaimer, the term of this patent is extended or adjusted under 35 U.S.C. 154(b) by 0 days.

(21) Appl. No.: 09/308,690

(22) PCT Filed: Nov. 25, 1997

(86) PCT No.: PCT/AU97/00799

§ 371 Date: Aug. 9, 1999

§ 102(e) Date: Aug. 9, 1999

(87) PCT Pub. No.: WO98/23421

PCT Pub. Date: Jun. 4, 1998

(30) Foreign Application Priority Data

Nov. 25, 1996 (AU) ..... PO3805

(51) Int. Cl.[7] ..... B27N 3/08; B27N 3/18; B27N 3/20

(52) U.S. Cl. ..... 264/517; 264/109; 264/122; 425/80.1; 425/406

(58) Field of Search ..... 264/109, 122, 264/517; 425/80.1, 406

(56) References Cited

U.S. PATENT DOCUMENTS 3,891,738 A * 6/1975 Shen
4,393,019 A * 7/1983 Geimer
4,517,147 A * 5/1985 Taylor et al.
4,684,489 A * 8/1987 Walter
4,937,024 A 6/1990 Hickson
5,246,652 A 9/1993 Hsu et al.

FOREIGN PATENT DOCUMENTS

| | | | |
|---|---|---|---|
| AU | 17668/95 A | | 11/1995 |
| CA | 1243172 | * | 10/1988 |
| DE | 3414178 A | | 10/1985 |
| GB | 2107244 A | | 4/1983 |
| JP | 06-254818 A | | 9/1984 |
| WO | WO 93/14913 A | | 8/1993 |
| WO | WO 97/04931 | | 2/1997 |

* cited by examiner

*Primary Examiner*—Leo B. Tentoni
(74) *Attorney, Agent, or Firm*—Nixon & Vanderhye PC

(57) ABSTRACT

A method and apparatus are disclosed for making a reconsolidated or reconstituted wood product from a charge of wood components and binder using steam injection pressing to consolidate and bind the charge into a mat in which the wood components are bound to each other to form the wood product. The charge is compressed into the mat by operation of at least the one pressing member in the form of a heated movable platen. The method and apparatus are characterized by the pressure being applied to the charge or mat from the steam injection pressing being independent of the compressing force applied to the charge or mat by the pressing member. The invention is particularly adapted to form beams of relatively large cross section, such as for example in excess of 30 mm, preferably larger than 40 mm.

35 Claims, 1 Drawing Sheet

MANUFACTURE OF RECONSTITUTED WOOD PRODUCTS

This application is the U.S national phase of international application PCT/AU97/00799 filed Nov. 25, 1997 which designaed the U.S.

BACKGROUND OF THE INVENTION

The present invention relates generally to the timber industry, and particularly to methods and apparatus for use in the manufacture of reconstituted or reconsolidated wood products. More particularly, the present invention relates to methods and apparatus for use in the manufacture of reconstituted wood products using steam pressing methods and apparatus, particularly steam injection pressing methods and apparatus. Even more particularly, the present invention finds application in making SCRIMBER® type wood products, particularly large beams of SCRIMBER or laminated typed products using a steam injection press.

Although the present invention will be described with particular reference to the manufacture of SCRIMBER wood products using steam pressing methods, particularly steam injection pressing methods, it is to be noted that the present invention is not limited in scope to the described arrangement, but rather the present invention is more extensive so as to include other methods and apparatus of producing similar or related products using similar or related methods and for other applications.

It is known to employ steam in methods and apparatus used in the timber industry generally, and in making reconstituted wood products. Such methods involve a "steam pressing" step or a "steam injection pressing" step and are used in the processes of making reconstituted or reconsolidated wood products such as particle boards (chipboards), oriented strand boards, medium density fibre boards, in the form of panels or beams or the like involving the use of adhesives or binders to bind the wood component materials together. Steam pressing is employed not only to compress the wood components, such as for example wood particles, chips, fibres, scrim, flakes, shavings or the like, but also to apply heat to cure the bonding agent or adhesive with which the component materials are mixed. Generally a charge of the wood components and adhesive or binder such as a suitable thermosetting resin is compressed between two platens to form a mat to which steam is introduced to form the wood product. The steam supplies the heat for plasticising the wooden components of the mat and for curing the thermosetting resin binder so that a panel, beam or similar of desired shape and size is formed. In methods and apparatus using steam injection methods, the steam is injected through perforations supplied in the platen or platens so that steam is passed into the mat at various locations over the surfaces of the mat. Examples of steam injection pressing are disclosed in, for example, U.S. Pat. No. 4,393,019 (Geimer) and U.S. Pat. No. 4,517,147 (Taylor and Reid).

The use of steam is well known in the timber processing industry to relieve stresses in both softwoods and hardwoods. Steam pressing of reconstituted timber-based products is regarded as being not only a method of supplying heat to a substrate but also as a means of improving stability of panel products by relieving stresses within the wood product. Such steaming has the effect of reducing the incidence and degree of checking and warping in timber products, for example.

Although known reconstituted wood products are usually manufactured as panels of relatively thin sectional thickness, such as for example a thickness of up to about 40 mm, it is more usual for such methods to be used in the manufacture of panels of thickness from 3 to 25 mm. When heating and pressing is used to manufacture these thinner panels, edge sealing of the mats is not normally necessary because the panel itself is of sufficient density and uniformity to prevent the lateral escape of steam, which is to say that the panel itself acts as its own seal to contain the steam within the bulk of the material in order to allow pressure and temperature to build up within the compressed mat. In steam injection pressing, this "self-sealing" property can be improved by leaving a relatively wide margin between the edges of the mat and the outside edge of the steam holes in the perforated platens compressing the mat to act as a steam seal, or by including a circumferential lip on the face of each platen which increases the compression in the surrounding edge region of the mat and thus seals the edges of the mat during compressing and steaming.

However, the lateral escape of steam from the external edges of the mat may become a problem for panels having thicknesses beyond about 50 mm. Also, the structure of some reconstituted wood products is unsuitable for providing the above-mentioned "self-sealing" property. For example, products manufactured from coarsely splintered wood may not provide a sufficient degree of homogeneity or uniformity to provide an adequate seal. An example of one such reconstituted product, which is perhaps more accurately described as a reconsolidated wood product, is that which is disclosed in Australian patent no. 510845 (Coleman).

U.S. Pat. No. 3,891,738 (Shen) describes a method of steam injection pressing in which the lateral escape of the stream from the fibre mat is prevented by using a sealing frame which is placed circumferencially around the edges of the mat between the platens. When the platens are pressed together against the sealing frame, a sealed chamber is formed which encloses the mat. The amount the platens are spaced apart from each other in the direction normal to the planes containing each of the platens determines the thickness of the resultant board or reconstituted wood product since the material being compressed is contained within the sealing frame, located between the two platens. Although this method and apparatus are said to be applicable to boards of thicknesses greater than 5 inches (125mm), they suffer several disadvantages. Firstly, the compressive force and the steam pressure applied to the mat are not independent of each other. The chamber cannot pressurise (via the lateral escape of steam from the mat) unless and until a seal has been formed between the surface of each platen and the adjacent end surface of the frame, and further, once the chamber does pressurise, the maintenance of this pressure depends in turn on the compressive force being maintained as this determines the seal being maintained. Secondly, it will be very difficult in practice, given the environment in which such apparatus is to perform, to ensure an acceptable seal is maintained between the platens and the frame. For example loose wood particles or splinters will almost certainly become lodged between the sealing surfaces of the platens and the side of the frame, thereby preventing these surfaces from coming into sealing engagement with each other to form the required seals. In addition, resin accumulation or resin build-up on the walls of the apparatus, frame, platen or the like can contribute to the lack of sealing of presses using such arrangements.

SUMMARY OF THE INVENTION

Therefore, it is an aim of the present invention to provide a method and apparatus which at least in part overcomes the disadvantages of existing methods and apparatus for forming wood products, particularly methods and apparatus using steam injection pressing to form reconstituted or reconsolidated wood products of relatively thick section. By their nature, such sections or products are relatively more permeable than the more finely comminuted elements used in, for example, thin panel products.

Another aim of the present invention is to provide a method and apparatus for use in steam pressing, particularly steam injection pressing of reconstituted or reconsolidated wood products of relatively thick sections of from 50 to 300 mm in depth.

It is another aim of the present invention to provide an improved method and apparatus using steam pressing to make reconstituted or reconsolidated wood products made form non-homogeneous starting materials or components, particularly from components which have a wide range of strand or particle sizes.

According to a first aspect of the present invention, there is provided a method of manufacturing a wood product comprising applying a bonding agent to the wood components to form a charge of treated wood components, consolidating the wood components to form a mat from the charge of wood components by applying pressure to the charge, and bonding the wood components together, applying steam to the charge to form the wood product, wherein the pressure applied to the charge from steam pressing is independent of the compressing force applied to the charge.

According to a second aspect of the present invention there is provided an apparatus for use in manufacturing a wood product, said apparatus comprising a pair of substantially parallel pressing members located in opposed facing relationship, at least one of the pressing members being capable of movement relative to another for compressing a charge of wood components located therebetween, wherein at least one of the pressing members is associated with means for admitting steam to the charge, wherein the pressure applied to the charge from steam pressing is independent of the compressing force applied to the charge by the pressing members.

Typically, the wood product is a reconstituted or reconsolidated wood product. More particularly, the wood component comprises wood particles, wood fibres, wood strands, wood splinters, wood chips, wood flakes, wood shavings, wood scrim, or wood in other comminuted form or in particles. In one embodiment, the strands of the wood component are interconnected wood strands in which the longitudinal axes of the strands extend substantially parallel to each other. Typically, for SCRIMBER and reconstituted beam products, the size of the wood components is from 0.25 mm to 20 mm, preferably from 0.5 mm to 15 mm, and more preferably from 1 mm to 10 mm in cross section. The invention may be characterized in that a substantial number of the strands align with their respective longitudinal axes substantially parallel to each other and substantially parallel to the lengthwise extending axis of the beam. The beam produced may be made from non-uniform wood strands of a relatively wide range of sizes, shapes and forms, but generally featuring a high aspect ratio.

Typically, the length of the wood product after pressing is preferably in the region of 1–5 m, preferably 2–3 m for convenience of handling the feedstock. Typically, the wood product has a thickness of from 30 mm to 500 mm, even more typically up to 300 mm, preferably up to 125 mm, more preferably up to 100 mm, even more preferably from 30 mm to 75 mm.

Typically, the width of the wood product is up to 500 mm, more typically up to 300 mm, preferably from 50 mm to 500 mm, more preferably 200 mm to 50 mm.

Typically, the pressing member is a platen. Even more typically, there are two pressing members in which at least one or both members are movable with respect to each other. Even more typically, one of the pressing members is movable and the other is stationary or fixed.

Typically, the steam pressing includes steam injection pressing. More typically, the platen includes means for injecting steam into the charge of wood components. More typically, the steam injection means includes a plurality of apertures, holes, bores, tubes, needles or the like.

Typically, the pressing members are located in a pressurisable chamber. More typically, the pressurisable chamber is pressurised by steam introduced to the charge or injected into the charge.

Typically, the steam under pressure may be injected to pass from one pressing member into and through the charge to exit through the other pressing member. More typically, steam is injected into the chamber and into the charge.

Typically, the steam may be injected through both pressing members, either simultaneously or sequentially.

Typically, the pressurisable chamber may be pressurised by a separate steam supply that by-passes the pressing members, or by directly supplying a pressurising gas, such as for example compressed air, to the chamber.

Typically, there is a range of pressures obtainable from the steam presses. Typically, the pressure of the steam presses is from 250–1000 kPa, more preferably 400–700 kPa, even more preferably 500–600 kPa. The pressure of steam should be chosen bearing in mind the setting characteristics of the chosen adhesive formulation at different temperatures.

Typically, the time of pressing, including steam injection pressing and other pressings, is from 1 to 10 minutes, more typically 2 to 5 minutes.

Typically, there is a flexible connection to the pressing plate or platen for conveying steam to the plate or platen during use or movement of the platen. More typically, the flexible connection is a flexible tube for introducing steam to the steam injection press.

Typically, the pressing members are a pair of substantially parallel plates arranged in oppositely facing parallel relationship, which are movable towards and away from each other in a direction normal to the planes containing the plates. More typically, the pressing members are platens. Even more typically, the platens are provided with apertures or bores through which steam may be injected.

Typically, the platens are provided with a heating means. More typically, the heating means is arranged so that a heat medium such as hot oil may flow through the platen in order to heat the platen to a desired temperature. Even more typically, the platen or platens or other pressing member have both heating means and steam injection means.

Typically, any suitable wood adhesive or binder may be used, depending on the specific wood source, required performance of product, and/or suitability for end use.

BRIEF DESCRIPTION OF THE DRAWINGS

The present invention will now be described by way of example with reference to the accompanying drawings in which.

DETAILED DESCRIPTION OF THE INVENTION

Figure 1:
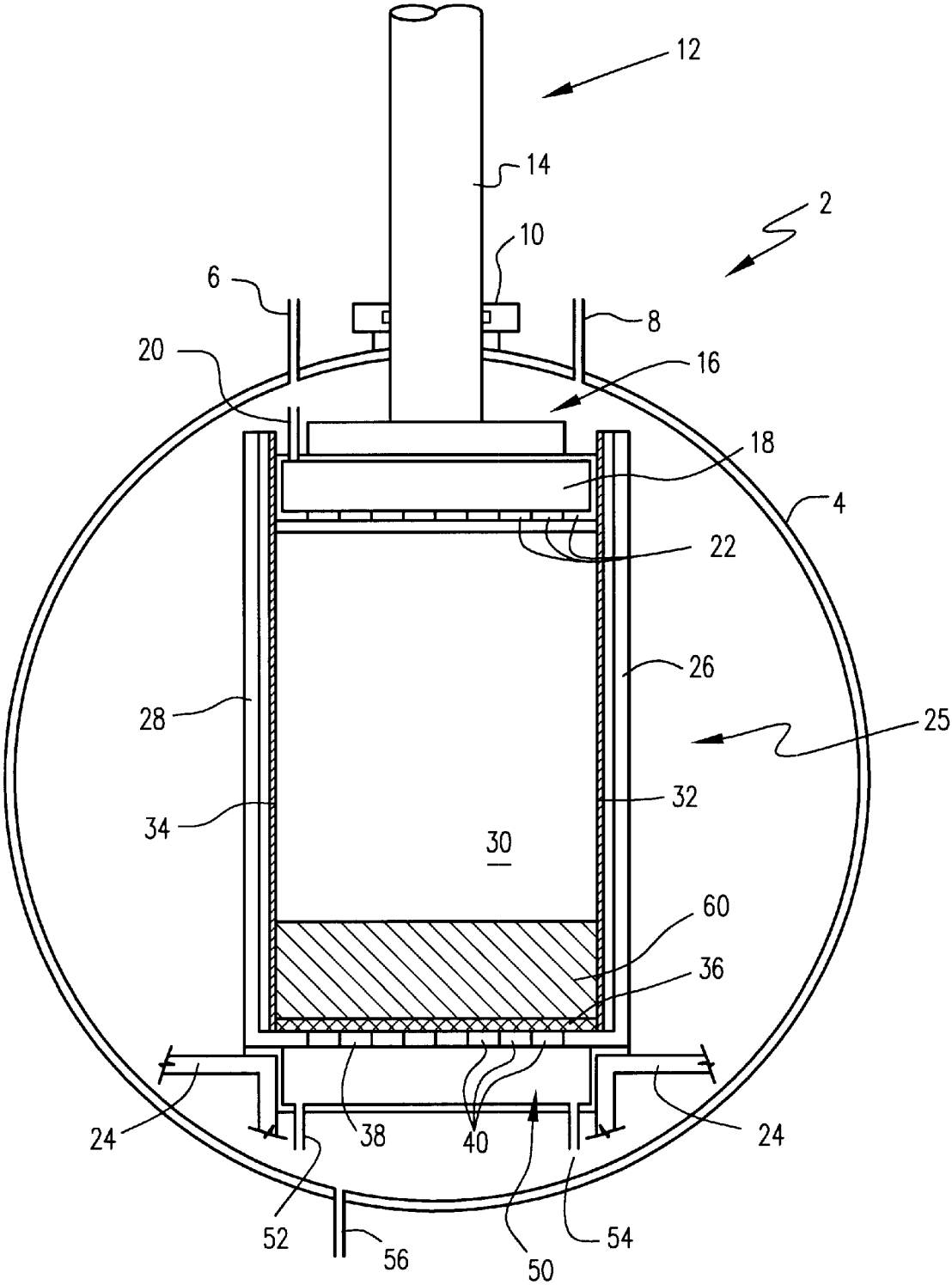
FIG. 1 is a schematic view of a cross-sectional view of one form of the apparatus of the present invention.

In FIG. 1 is shown schematically one form of the apparatus of the present invention in which the method of the present invention can be conducted, being a steam injection pressing apparatus, generally denoted as 2. A charge of wood components located inside the apparatus is compressed and steam pressed to form firstly a mat and then the wood product. The steam injection pressing sealing apparatus 2 comprises a generally cylindrical pressure vessel 4 having at least one opening door at one end which can be sealingly closed and optionally a second sealing door at the other end. Pressure vessel 4 is capable of withstanding high pressures, such as for example up to 1000 kPa. In some embodiments, vessel 4 is a conventionally sized and shaped pressure vessel. The pressure vessel 4 is provided with a steam inlet 6 for admitting steam under pressure and an air vent 8 for exhausting air from the vessel, both located at or towards the top of vessel 4 when in its normal in use orientation. Although the described embodiment shows one or other steam introduction point, it is to be noted that steam can be introduced into the apparatus in any suitable or desirable manner.

A gland 10 or similar sealing arrangement is also located on the top surface of vessel 4 intermediate steam inlet 6 and vent 8. A driving rod 14 of a ram 12 is sealingly received through gland 10 for axial movement therethrough. A plate 16 is connected to the distal end of rod 14 for movement in accordance with corresponding movement of rod 14. Plate 16 may take any number of different forms. One form of plate 16 is provided by a press platen 18 which is connected to the driving rod of ram 12. Platen 18 is provided with steam conduit 20 to admit steam into the interior of the platen. In one embodiment, platen 18 contains a plurality of small apertures 22 or similar, such as bores, tubes, holes or the like through which pressurised steam, supplied to platen 18 via steam inlet 6 and steam conduit 20 is injected through the platen to contact any material located in the apparatus or in contact with the surface of platen 18. In another embodiment there is a flexible tube (not shown) extending from the wall of pressure vessel 4 to platen 18 for connection to apertures 22 to admit steam under pressure to the charge directly. The flexible tube allows platen 18 to move whilst maintaining the supply of steam.

A platform 24 is provided at or towards the lower portion of vessel 4 in its normal in use orientation upon which is supported a frame arrangement 25 for receiving the charge of wood components for forming the wood product. The arrangement 25 comprises a pair of oppositely facing side walls 26, 28 and a pair of oppositely facing end walls (not shown). The walls and ends may be fixed to each other in one embodiment or may be removable or hinged, allowing relative movement thereof in another embodiment to aid in loading the charge and removing the wood product. A mould or form 30 is locatable internally within frame arrangement 25. In one embodiment, form 30 is a loading tray or other receptacle for receiving the charge of wood components. In one embodiment, form 30 comprises a pair of oppositely facing side walls 32, 34 arranged substantially in parallel relationship with each other and also with the pair of side walls 26, 28 of frame 25. Form 30 is movable inside frame 24, such as for example by being slidably movable along the floor or base of the frame arrangement.

The floor or base 36 of form 30 is a mesh arrangement and the floor or base 38 of frame 25 is provided with a plurality of spaced apart apertures, bores, tubes 40 or the like, both for admitting steam under pressure into form 30 and for allowing any steam condensate or liquid to drain away from form 30.

A drain or similar 50 is provided immediately beneath the floor 38 of frame 25 for receiving steam or steam condensate after passing through the charge located in form 30 once through apertures 40. Drain 50 is provided with a steam conduit 52 for admitting steam under pressure into drain 50 to facilitate steam pressing of the charge by the steam flowing through apertures 40 and mesh 36, and a steam condensate outlet 54 for draining fluids from frame 25. Drain 50 is provided with rebated edges 56 which assist in locating frame 25 on platform 24. Pressure vessel 4 is provided with a discharge outlet 56 located at the lower surface for discharging spent steam or liquids from vessel 4.

In one embodiment, distribution means in the form of mesh or similar may be provided over the floor, side walls and ends to more evenly distribute steam over the surfaces of and through the bulk of the charge of wood components.

In operation of the apparatus of the present invention, the wood components in whatever form is desirable or convenient, such as particles, chips, flakes, fibres, fillets, shavings, scrim or the like, together with a suitable adhesive or binding agent, is loaded into form 30 which in turn is located within pressure vessel 4 by a suitable means, such as for example form 30 being provided with trolley wheels, rollers or similar (not shown). When form 30 is in place, pressure vessel 4 is sealed.

Ram 6 is operated to lower platen 18 to contact the upper surface of the charge and then continues to compress the charge into a mat 60. The mat 60 is shown schematically in FIG. 1 as being contained in the lower portion of form 30.

Typically, in this example, the charge is compressed to a maximum thickness of up to 75 mm, using a compression rati of 5:1. However, it is to be noted that the mat can be compressed to any thickness that is desirable or convenient to form the desired thickness of wood product which is typically from 30 mm to 500 mm and has a width of 50 mm to 500 mm, more typically 200 mm to 500 mm.

After the charge has been compressed to the desired thickness, steam is introduced into pressure vessel 4 through steam inlets 6 and into form 40 through steam conduits 30, 52 where it is then injected into the mat through the apertures 22, 40 provided in platen 18 and floor 38.

The steam, after passing through the mat, is expelled from the mat in the form of steam or steam condensate which is collected in drain 50 and discharged through steam condensate outlet 54 and discharge outlet 56.

It is to be noted that steam can be admitted to the vessel through any of the inlets or outlets in any order or sequence, depending on circumstances.

Modifications of the method and apparatus include the following.

A vacuum may be applied to the steam inlets, either before of after the steam injection step, for any desired purposes such as for example the control of moisture content and/or temperature or to relieve stress within the mat or compressed board or panel, or to improve stability of the wood product.

A sequence of steam injections and vacuum applications may be employed to achieve desired results or properties.

Another embodiment includes having two platens relatively movable towards and away from each other to compress the charge into a mat and then into the wood product. In this embodiment, the second or lower platen forms the floor or base of the form 30.

Operation of the apparatus of the present invention will now be described with reference to the following example.

EXAMPLE

This example demonstrates application of the method of the invention to the manufacture of a reconsolidated wood product from flexible open lattice work webs of naturally interconnected *Pinus radiata* wood strands of the type disclosed in Australian patent no. 510845.

The *P. radiata* wood strands, precoated with 5–10% w/w of a tannin-urea formaldehyde adhesive, were placed in the loading tray or form 30 of an apparatus of the type depicted in FIG. 1. The mat 60 of strands was compressed at 700 kPa platen pressure at a compression ratio of 4:1 and steam at 500 kPa pressure introduced through steam inlet 6, and steam conduits 20, 52, and then through perforated platen 18 for a period of 60 seconds. The steam supply was then shut off and a vacuum applied to the compressed product through the steam inlet for a period of 4 minutes. The compression pressure was then released. The resultant reconsolidated wood product had a thickness of 100 mm and a density typically in the range 0.5 to 0.6.

Advantages of the present invention include the following.

Beams made from reconstituted or reconsolidated wood components having relatively large cross-sections of typically in excess of 40 mm thick or deep can be made using the method and apparatus of the present invention, which beams have more uniform properties and the properties of the beams are more uniformly reproducible.

The described arrangement has been advanced by explanation and many modifications may be made without departing from the spirit and scope of the invention which includes every novel feature and novel combination of features herein disclosed.

Those skilled in the art will appreciate that the invention described herein is susceptible to variations and modifications other than those specifically described. It is understood that the invention includes all such variations and modifications which fall within the spirit and scope.

What is claimed is:

1. A method of manufacturing a wood product comprising the steps of:

mixing a bonding agent with elements of a wood component to form a charge of the wood components, locating the charge of the wood components in a pressure vessel, substantially sealing the pressure vessel, admitting steam to the pressure vessel to pressurize the pressure vessel so as to apply steam under pressure to the charge located within the pressure vessel, thereby steam pressing the charge, and compressing the charge with a compression means located within the pressure vessel while maintaining steam pressing of the charge, wherein the wood components are consolidated into the wood product by a combination of the steam pressing and compressing force applied to the components, and wherein the pressure applied to the charge due to the steam pressing is independent of the compressing force applied to the charge by the compression means.

2. A method according to claim 1 in which the elements of the wood component comprise at least one of wood particles, wood fibres, wood strands, wood splinters, wood chips, wood flakes, wood shavings, wood scrim, and wood in other comminuted forms.

3. A method according to claim 2 in which the elements of the wood component are interconnected wood strands or scrim in which the longitudinal axes of the strands or scrim extend substantially parallel to each other.

4. A method according to claim 3 in which the strands or scrim of the wood component have a thickness or width in the range of 0.25 mm to 20 mm.

5. A method according to claim 4 in which the strands or scrim of the wood component have a thickness or width in the range of 0.5 mm to 15 mm.

6. A method according to claim 4 in which the strands or scrim of the wood component have a thickness or width in the range of 1 mm to 10 mm.

7. A method according to claim 3 in which a substantial number of the strands or scrim align with their respective longitudinal axis substantially parallel to each other and substantially parallel to the lengthwise extending axis of the wood product.

8. A method according to claim 1 in which the wood product is a board, panel or beam.

9. A method according to claim 8 in which the wood product is a beam which is a reconstituted or reconsolidated wood product obtained from scrim.

10. A method according to claim 9 in which the beam has a cross-sectional width of from 30 mm to 500 mm.

11. A method according to claim 10 in which the beam has a cross-sectional width of from 50 mm to 300 mm.

12. A method according to claim 10 in which the beam has a cross-sectional width of from 80 mm to 200 mm.

13. A method according to claim 9 in which the beam has a cross-sectional width of from 250 mm to 750 mm.

14. A method according to claim 13 in which the beam has a cross-sectional width of from 200 mm to 600 mm.

15. A method according to claim 3 in which the wood product is made from non-uniform wood strands or scrim of a relatively wide range of sizes, shapes and forms but generally featuring a high aspect ratio.

16. A method according to claim 1 in which the steam pressing includes steam injection pressing in which steam is injected at lease one of onto the surface of and into the mass of the charge.

17. A method according to claim 16 in which the compressing means includes two pressing members movable with respect to each other so that steam under pressure is injected to pass from one pressing member into and through the charge to exit through the other pressing member.

18. A method according to claim 17 in which the steam is injected through both pressing members either simultaneously or sequentially.

19. A method according to claim 1 in which the pressure applied to the charge from steam pressing is due to the pressure of steam admitted to the pressure vessel whereas the compressing force applied to the charge by the compression means is due to mechanical pressure applied to the compression means within the pressure vessel.

20. An apparatus for use in manufacturing a wood product from a charge of elements of a wood component comprising:

a pair of substantially parallel pressing members located in opposed facing relationship within a pressure vessel, at least one of the pressing members being capable of movement relative to the other of the pressing members for compressing a charge of elements of the wood component located therebetween within the pressure vessel, and means for introducing steam under pressure to the pressure vessel for pressurizing the vessel so as to apply steam under pressure to the wood components located within the pressure vessel, thereby steam pressurizing the charge, wherein at least one of the pressing members is associated with the means for admitting steam to the charge so as to apply steam pressure to the charge while compressing the charge with the pressing members, and wherein the pressure applied to the charge from steam pressing is independent of the pressing force applied to the charge from the pressing members.

21. An apparatus according to claim 20 in which the elements of the wood component are interconnected and are arranged so that the longitudinal axes of the elements extend substantially parallel to each other.

22. An apparatus according to claim 20 in which at least one of the pressing members is a platen in which the platen that is movable with respect to another platen or a fixed surface.

23. An apparatus according to claim 22 in which the platen is provided with steam injection means.

24. An apparatus according to claim 23 in which the steam injection means includes a plurality of apertures, holes, bores, tubes, needles, or injectors.

25. An apparatus according to claim 20 in which the pressurizable vessel is pressurized by a separate steam supply that bypasses the pressing member or members or the pressure vessel is pressurized by directly supplying a pressurizing gas.

26. An apparatus according to claim 25 in which the pressurizing gas is air, nitrogen, or combinations thereof.

27. An apparatus according to claim 22 in which the platens are further provided with heating means, wherein the heating means is arranged so that a heat medium flows through the platen.

28. An apparatus according to claim 27 in which the heat medium is a hot oil.

29. An apparatus to claim 23 in which the pressure applied or attributed to the steam injection is from 250 to 1000 kPa.

30. An apparatus according to claim 29 in which the pressure applied or attributed to the steam injection is from 400 to 700 kPa.

31. An apparatus according to claim 29 in which the pressure applied or attributed to the steam injection is from 500 to 600 kPa.

32. An apparatus according to claim 31 in which the time pressure is applied is from 1 to 10 minutes.

33. An apparatus according to claim 30 in which the time pressure is applied is from 2 to 5 minutes.

34. A method of manufacturing a wood product comprising the steps of:

mixing a bonding agent with elements of a wood component to form a charge of the wood components, locating the charge of the wood components in a pressure vessel with the charge being received within a wall structure within the pressure vessel, said wall structure comprising a pair of opposed side walls which act to confine the charge laterally, substantially sealing the pressure vessel, admitting steam to the pressure vessel to pressurize the pressure vessel so as to apply steam under pressure to the charge confined within the wall structure located within the pressure vessel, thereby steam pressing the charge, and compressing the charge with a compression means located within the pressure vessel and movable within the wall structure while maintaining steam pressing of the charge, wherein the wood components are consolidated into the wood product by a combination of the steam pressing and compressing force applied to the components, and wherein the pressure applied to charge due to the steam pressing is independent of the compressing force applied to the charge by the compression means.

35. An apparatus for use in manufacturing a wood product from a charge of elements of a wood component, comprising:

a pair of substantially parallel pressing members located in opposed facing relationship within a pressure vessel, a wall structure comprising a pair of opposed side walls co-operating with said pressing members to define therewith a space for receiving the charge, the side walls acting to confine the charge laterally, at least one of the pressing members being capable of movement within the wall structure relative to the other of the pressing members for compressing the charge within said space, and means for introducing steam under pressure to the pressure vessel for pressurizing the vessel so as to apply steam under pressure to the charge within the space, thereby steam pressuring the charge, wherein at least one of the pressing members is associated with the means for admitting steam to the charge so as to apply steam pressure to the charge while compressing the charge with the pressing members, and wherein the pressure applied to the charge from steam pressing is independent of the pressing force applied to the charge from the pressing members.

* * * * *